United States Patent [19]

Baltz et al.

[11] Patent Number: 5,057,249

[45] Date of Patent: Oct. 15, 1991

[54] CARBURETOR FLOAT CHAMBER DRAIN DEVICE

[75] Inventors: Gene F. Baltz, Lake Villa; Paul M. Dayenian, Waukegan, both of Ill.; John E. Stanley, Kenosha, Wis.

[73] Assignee: Outboard Marine Corporation, Waukegan, Ill.

[21] Appl. No.: 537,649

[22] Filed: Jun. 14, 1990

[51] Int. Cl.[5] ..... F02M 19/00

[52] U.S. Cl. ..... 261/72.1; 251/143; 251/346

[58] Field of Search ..... 261/72.1; 251/143, 346, 251/351

[56] References Cited

U.S. PATENT DOCUMENTS

| | | | |
|---|---|---|---|
| 1,423,418 | 7/1922 | Grikscheit | 251/346 |
| 2,718,386 | 9/1955 | Henning | 261/72.1 |
| 2,790,458 | 4/1957 | Kalert, Jr. | 261/72.1 |
| 2,804,279 | 8/1957 | Gould | 251/351 |
| 2,973,947 | 3/1961 | Sterner | 261/72.1 |
| 3,196,688 | 7/1965 | Smith | 251/351 |
| 3,231,250 | 1/1966 | Kalert, Jr. | 261/72.1 |
| 3,307,836 | 3/1967 | Amdt et al. | 261/34.1 |
| 3,727,638 | 4/1973 | Zavemba, Jr. et al. | 251/346 |
| 3,780,996 | 12/1973 | Nutten | 261/72.1 |
| 3,910,550 | 10/1975 | Nelson | 251/144 |
| 4,100,232 | 7/1978 | Kaye | 261/36 A |
| 4,254,064 | 3/1981 | Bernauer et al. | 261/64 E |
| 4,461,250 | 7/1984 | Mohr | 123/198 R |
| 4,776,988 | 10/1988 | Neal | 261/72.1 |
| 4,793,950 | 12/1988 | Hedlund | 261/4 |
| 4,807,847 | 2/1989 | Martz | 251/351 |

FOREIGN PATENT DOCUMENTS

| | | | |
|---|---|---|---|
| 826744 | 4/1938 | France | 261/72.1 |

*Primary Examiner*—Tim Miles

*Attorney, Agent, or Firm*—Michael, Best & Friedrich

[57] ABSTRACT

A device for draining carburetors which do not have a float chamber drain. The device is a screw which has an internal passageway. The internal passageway has a longitudinal passageway beginning at the head of the screw and a transverse passageway which communicates with the float chamber and intersects the longitudinal passageway. A drain plug is threaded into the longitudinal passageway near the head of the screw.

15 Claims, 2 Drawing Sheets

CARBURETOR FLOAT CHAMBER DRAIN DEVICE

BACKGROUND OF THE INVENTION

1. Field of the Invention

This invention relates to carburetors, and more particularly, to drain devices for carburetors.

2. Description of the Prior Art

It is sometimes necessary to drain fuel from the carburetor of an internal combustion engine. To accomplish this draining, many carburetors have a drainage outlet at the lowermost point of the float chamber.

Attention is directed to the following U.S. patents.

| U.S. Pat. No. | Inventor | Issue Date |
|---|---|---|
| 4,793,950 | Hedlund | December 27, 1988 |
| 4,461,250 | Mohr | July 24, 1984 |
| 4,254,064 | Bernauer et al. | March 3, 1981 |
| 4,100,232 | Kaye | July 11, 1978 |

SUMMARY OF THE INVENTION

The invention provides a carburetor comprising a main body, a float bowl defining a float chamber, means for connecting the float bowl to the main body, and means for draining the float chamber, the draining means being located in the connecting means.

The invention also provides a screw having a head end and a longitudinal axis, the screw further having a passageway including a longitudinal portion extending from the head of the screw and along the longitudinal axis, and a transverse portion extending transversely to the longitudinal axis.

The invention also provides an apparatus having a main body, a second body defining a chamber adapted to contain fluid, means for connecting the second body to the main body, and means for draining the chamber, the draining means being located in the connecting means.

A principal feature of the invention is the provision of float chamber draining means located in the means for connecting the float bowl to the main body of the carburetor. Certain carburetors, such as Holley carburetors, do not have a float chamber drain device. This means that in order to drain the carburetor, either the entire carburetor must be removed from the engine or the float bowl retaining screw and gasket must be removed. Removing the entire carburetor takes a lot of time and removing the float chamber retaining screw and gasket may not be feasible due to the inability to check for proper sealing of the gasket after draining. Having means for draining the float chamber located in the means for connecting the float bowl to the main body will substantially alleviate the need to either remove the entire carburetor from the engine or remove the float bowl retaining screw and gasket to drain the carburetor.

Other principal features and advantages of the invention will become apparent to those skilled in the art upon review of the following detailed description, claims and drawings.

Figure 1:
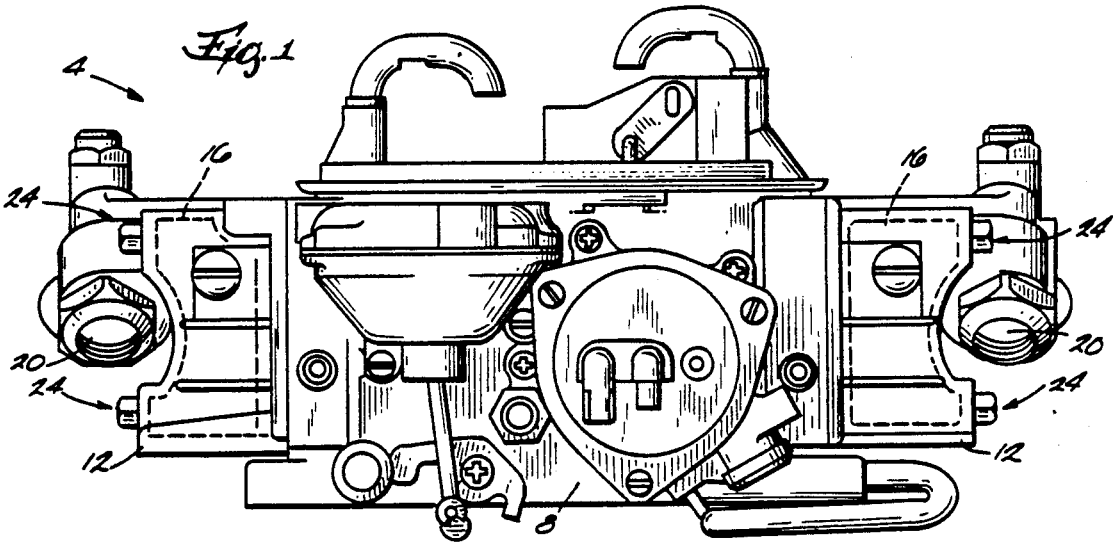
FIG. 1 is a front view of a carburetor embodying the present invention.

Before one embodiment of the invention is explained in detail, it is to be understood that the invention is not limited in its application to the details of construction and the arrangement of components set forth in the following description or illustrated in the drawings. The invention is capable of other embodiments and of being practiced or carried out in various ways. Also, it should be understood that the phraseology and terminology used herein is for the purpose of description and should not be regarded as limiting.

DESCRIPTION OF THE PREFERRED EMBODIMENT

A carburetor 4 embodying the invention is illustrated in FIGS. 1–4. While the carburetor can have various constructions, in the preferred embodiment, the carburetor 4 is a Holley carburetor.

The carburetor comprises a first or main body 8 including (see FIG. 4) a plurality of intake passageways 10. The carburetor also comprises a plurality of throttle valves 11 with each valve 11 being located in a respective passageway 10. The carburetor 4 also comprises left and right second bodies or float bowls 12 defining respective float chambers 16. Each float chamber 16 acts as a reservoir for holding a supply of fuel that enters from a fuel inlet line 20. Means (not shown) are provided for drawing fuel from the float chamber 16 into one or more of the intake passageways 10 to mix with air and pass into the combustion chamber of an internal combustion engine (not shown). Such means are well-known in the art.

Figure 2:
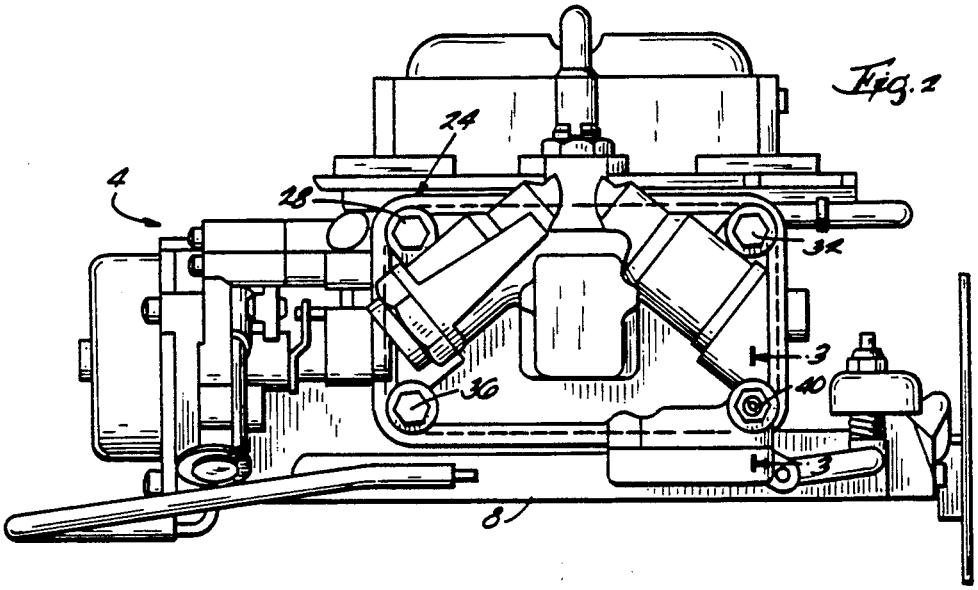
FIG. 2 is a side view of the carburetor.

The float bowls 12 are substantially mirror images of each other, and only the right float bowl 12 will be described in greater detail. Means 24 are provided for connecting the float bowl 12 to the main body 8. Any suitable connecting means may be used, but preferably screws are used. As shown in FIG. 2, two top screws 28 and 32 and two bottom screws 36 and 40 are used to connect the float bowl 12 to the main body 8. The screws 36 and 40 extend through the float chamber 16. A gasket 41 (only one is shown—see FIG. 3) is located between each of the screws 28, 32, 36 and 40 and the float bowl 12 to help seal the screw and prevent fuel leakage from the float chamber 16. Also, a gasket 43 is located between the float bowl 12 and the main body 8.

The carburetor 4 also comprises means located in one or both of the two bottom screws 36 and 40 for draining the float chamber 16. To simplify the discussion, only the bottom screw 40 will be discussed, although it is possible for either or both of these screws 36 and 40 to contain the means for draining the float chamber 16.

Figure 3:
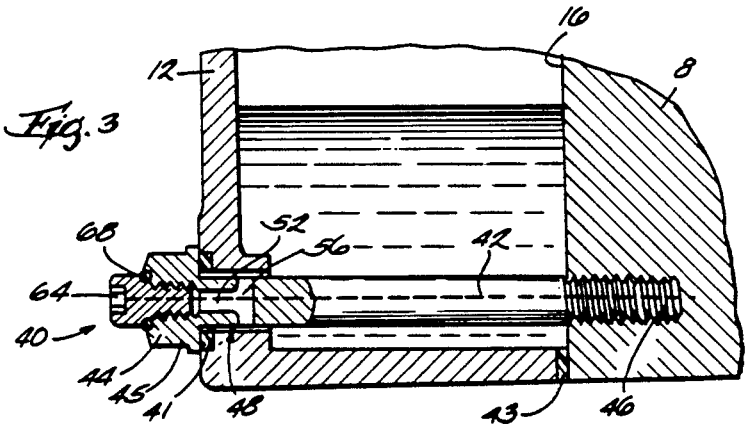
FIG. 3 is a sectional view through line 2—2 indicated in FIG. 2.
Figure 4:
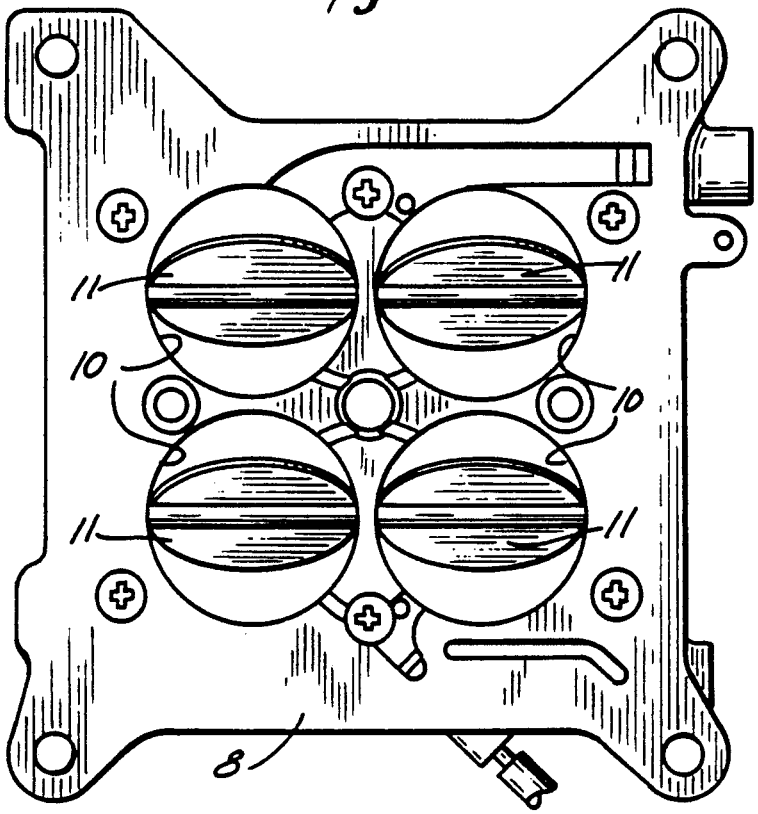
FIG. 4 is a bottom view of the carburetor.

As shown in FIG. 3, bottom screw 40 has a longitudinal axis 42, a head end 44 located exteriorly of the float chamber 16, a head portion 45 adjacent the head end 44 and a shank portion 46 which has an exterior. The draining means includes, in the screw 40, an internal passageway 48 which communicates with the float chamber 16. This internal passageway 48 is at least partially internally threaded and includes a longitudinal portion 52 which has a chamfered outer end and which extends from the head end 44 of the screw 40 along the longitudinal axis 42 of the screw 40. This internal passageway 48 further includes a transverse portion 56 which has opposite ends and which extends transversely to the longitudinal axis 42. Each of the two ends of the transverse portion 56 communicates with the exterior of the shank portion 46 and the float chamber 16, and the middle of the transverse portion 56 communicates with the longitudinal portion 52 of the passageway 48.

Selectively removable means for closing the passageway 48 are provided. While various suitable means can be employed, in the preferred embodiment, the closing means includes a drain plug 64 threaded into the longitudinal portion 52 of the passageway 48. Positive sealing of the drain plug 64 is provided by a seal such as an o-ring 68 which is located in the chamfered outer end of the screw 40 and between the plug 64 and the screw 40. Preferably, the drain plug 64 is provided with a standard external hex head and an internal hex to allow for easy access to and removal of the drain plug 64.

To drain fuel from the float chamber 16, the drain plug 64 is removed and the fuel drains out through the internal passageway 48. After draining, the drain plug 64 is installed and tightened into place.

Various features of the invention are set forth in the following claims.

We claim:

1. A carburetor comprising a main body, a float bowl defining a float chamber, means for connecting said float bowl to said main body, means for draining said float chamber, said draining means being located in said connecting means and comprising a fastening screw extending through a side of said float bowl and screwed into said carburetor body, having an internal passage therethrough communication with said float bowl and with a portion of said screw exterior of said bowl, and closure means normally closing said passage and operable when desired for draining said bowl.

2. The carburetor of claim 1 wherein said screw includes a head end located exteriorly of said float chamber, and wherein said passage extends from said head end of said screw.

3. The carburetor of cliam 1 wherein said screw has a longitudinal axis, and wherein said passage includes a longitudinal portion extending along said longitudinal axis and a transverse portion extending transversely to said longitudinal axis.

4. The carburetor of claim 3 wherein said screw includes a head end located exteriorly of said float chamber, wherein said longitudinal portion of said passage extends from said head end, and wherein said transverse portion of said passage communicates with said float chamber.

5. The carburetor of claim 1 wherein said passage is at least partially internally threaded, and wherein said closure means includes a drain plug threaded into said passage.

6. The carburetor of claim 5 wherein said draining means further includes a seal located between said plug and said screw.

7. A carburetor comprising a main body, a float bowl defining a float chamber, means for connecting said float bowl to said main body, said connecting means including a screw extending through said float chamber, said screw including a longitudinal axis, a head end located exteriorly of said float chamber, a threaded portion screwed into said main body, and an unthreaded shank portion which is located between said head end and said threaded portion, which has an exterior, and which extends between said main body and said float bowl, and means for draining said float chamber, said draining menas being located in said connecting means, and said draining means including, in said screw, a passageway including a longitudinal portion extending from said head end of said screw and along said longitudinal axis, and a transverse portion extending transversely to said longitudinal axis and communicating with the exterior of said shank portion and with said float chamber.

8. A carburetor comprising a main body, a float bowl defining a float chamber, means for connecting said float bowl to said main body, said connecting means including a screw extending through said float chamber, and means for draining said float chamber, said draining means being located in said connecting means, said draining means including, in said screw, a passageway communicating with said float chamber, said passageway being at least partially internally threaded, and said passageway having a chamfered outer end, said draining means also including selectively removable means for closing said passageway, said closing means including a drain plug threaded into said passageway, and said draining means further including a seal located between said plug and said screw, said seal engaging said chamfered outer end.

9. The carburetor of claim 8 wherein said screw includes a head end located exteriorly of said float chamber, and wherein said passageway extends from said head end of said screw.

10. The carburetor of claim 8 wherein said screw has a longitudinal axis, and wherein said passageway includes a longitudinal portion extending along said longitudinal axis and a transverse portion extending transversely to said longitudinal axis.

11. The carburetor of claim 10 wherein said screw includes a head end located exteriorly of said float chamber, wherein said longitudinal portion of said passageway extends from said head end, and wherein said transverse portion of said passageway communicates with said float chamber.

12. An apparatus comprising a main body, a second body defining a chamber adapted to contain fluid, means for connecting said second body to said main body, said connecting means including a screw extending through said chamber, and means for draining said chamber, said draining means being located in said connecting means, said draining means including, in said screw, a passageway communicating with said chamber, said passageway being at least partially internally threaded, and said passageway having a chamfered outer end, said draining means also including selectively removable means for closing said passageway, said closing means including a drain plug threaded into said passageway, and said draining means further including a seal located between said plug and said screw, said seal engaging said chamfered outer end.

13. The apparatus of claim 12 wherein said screw includes a head end located exteriorly of said chamber, and wherein said passageway extends from said head end of said screw.

14. The apparatus of claim 12 wherein said screw has a longitudinal axis, and wherein said passageway includesa a longitudinal portion extending along said longitudinal axis and a transverse portion extending transversely to said longitudinal axis.

15. The apparatus of claim 14 wherein said screw includes a head end located exteriorly of said chamber, wherein said longitudinal portion of said passageway extends from said head end, and wherein said transverse portion of said passageway communicates with said chamber.

* * * * *